US009878426B2

(12) United States Patent
Kono et al.

(10) Patent No.: US 9,878,426 B2
(45) Date of Patent: Jan. 30, 2018

(54) MANUFACTURING METHOD FOR GRINDING WHEEL

(71) Applicant: TOYODA VAN MOPPES LTD., Okazaki-shi (JP)

(72) Inventors: Takuma Kono, Okazaki (JP); Takashi Kojima, Okazaki (JP); Motohiro Mizuno, Okazaki (JP); Takumi Masuda, Okazaki (JP)

(73) Assignee: TOYODA VAN MOPPES LTD., Okazaki-shi (JP)

( * ) Notice: Subject to any disclaimer, the term of this patent is extended or adjusted under 35 U.S.C. 154(b) by 247 days.

(21) Appl. No.: 14/921,252

(22) Filed: Oct. 23, 2015

(65) Prior Publication Data

US 2016/0184977 A1 Jun. 30, 2016

(30) Foreign Application Priority Data

Dec. 24, 2014 (JP) ..... 2014-260982

(51) Int. Cl.
*C09K 3/14* (2006.01)
*B24D 18/00* (2006.01)
*B24D 5/06* (2006.01)

(52) U.S. Cl.
CPC ..... *B24D 18/0072* (2013.01); *B24D 5/06* (2013.01)

(58) Field of Classification Search
None
See application file for complete search history.

(56) References Cited

U.S. PATENT DOCUMENTS 1,979,074 A * 10/1934 Larsson ..... B24D 5/06 451/543
2,818,692 A * 1/1958 Bernstein ..... B24D 13/04 451/469

(Continued)

FOREIGN PATENT DOCUMENTS

| | | |
|---|---|---|
| JP | S55-70572 | 5/1980 |
| JP | 2003-191164 | 7/2003 |
| JP | 2006-342844 | 12/2006 |

OTHER PUBLICATIONS

Office Acton dated Oct. 24, 2011 an Japanese Patent Application No. 2014-260982 (with machine translation).

*Primary Examiner* — Kaj K Olsen
*Assistant Examiner* — Ross J Christie
(74) *Attorney, Agent, or Firm* — Oblon, McClelland, Maier & Neustadt, L.L.P.

(57) ABSTRACT

A method for manufacturing a grinding wheel which is formed by fitting a cylindrical grindstone chip including abrasive grains to a base metal formed to be of a columnar shape, comprises an adhesive agent applying step, a linear guide member arranging step for arranging and attaching a plurality of linear guide members on at least one of the outer peripheral surface of the base metal and the inner peripheral surface of the cylindrical grindstone chip, in parallel with a rotation axis of the base metal and with an equal distance separated in a circumferential direction from one another and a base metal and grindstone chip fitting step for fitting the base metal and the cylindrical grindstone chip to each other by relatively moving the base metal and the cylindrical grindstone chip, interposing therebetween the plurality of linear guide members arranged and attached with the equal distance separated from one another.

8 Claims, 5 Drawing Sheets

(56) References Cited

U.S. PATENT DOCUMENTS

| | | | | |
|---|---|---|---|---|
| 2,820,746 | A * | 1/1958 | Keeleric | 51/298 |
| 3,145,511 | A * | 8/1964 | Bird | B24D 9/04 407/29.12 |
| 4,490,158 | A * | 12/1984 | Kuromatsu | B23H 5/08 51/295 |
| 6,238,448 | B1 * | 5/2001 | Rouse | B02C 7/12 51/298 |
| 2009/0156100 | A1 * | 6/2009 | Garcia | B24B 5/37 451/49 |
| 2015/0258657 | A1 * | 9/2015 | Su | H01L 24/97 451/6 |

* cited by examiner

MANUFACTURING METHOD FOR GRINDING WHEEL

INCORPORATION BY REFERENCE

This application is based on and claims priority under 35 U.S.C. 119 with respect to Japanese Application No. 2014-260982 filed on Dec. 24, 2014, the entire content of which is incorporated herein by reference.

BACKGROUND OF THE INVENTION

Field of the Invention

This invention relates to a method for manufacturing a grinding wheel by fitting a cylindrical grindstone chip to a columnar base metal.

Description of Related Arts

A grinding wheel having a grinding surface at the outer peripheral surface thereof is formed by coating an abrasive grain layer onto an outer peripheral portion of the columnar base metal (wheel base). One example of forming such abrasive grain layer on the outer peripheral portion of the columnar base metal is known, for example, as shown in FIG. 10 of this specification, wherein after applying an adhesive agent 28 on the inner peripheral surface of the cylindrical grindstone chip 14 and the outer peripheral surface of the columnar base metal 4, the cylindrical grindstone chip 14 is fitted to the columnar base metal 4 whose rotation axis is set in a vertical direction, so that the chip 14 is layered on the base metal 4 by approximating the chip 14 toward the base metal 4 from upward to thereby form a grinding wheel.

DISCLOSURE OF INVENTION

Problems to be Solved by the Invention

However, according to the conventional technology shown in FIG. 11, the grinding wheel indicates that the adhesive agent 28 has been filled between the cylindrical grindstone chip 14 and the base metal 4 to form an adhesion layer 34 therebetween, wherein there is a risk that air may be mixed into the adhesive agent 28 to generate an air bubble AB. If such air bubble AB is generated in the adhesion layer 34, the strength of the abrasive grain layer of the grinding wheel formed on the outer periphery of the base metal 4 may be deteriorated.

As a cause of generation of such air bubble AB, as shown in FIGS. 12 and 13, it is considered that the air is mixed into the adhesive agent 28 between the cylindrical grindstone chip 14 and the base metal 4 due to an uneven distribution of the adhesive agent 28 that forms the adhesion layer 34, the uneven distribution being caused by generation of a surface elevation of the adhesive agent 28 or a shaving off thereof which is made by an end brim of the cylindrical grindstone chip 14 by an inclination of the cylindrical grindstone chip 14 relative to the axis center of overlapping direction while the cylindrical grindstone chip 14 is fitted to the base metal 4.

The present invention was made considering the above issues of the conventional technology and it is an object of the present invention to provide a method for manufacturing a grinding wheel by which the cylindrical grindstone chip forming an abrasive grin layer at the outer periphery of the grinding wheel is fitted to a columnar base metal which forms a core of the grinding wheel without causing an air bubble in an adhesion layer between the cylindrical grindstone chip and the base metal.

Means to Solve the Problems

In order to solve the above conventional problems, a feature of the invention associated with a first aspect is that the method for manufacturing a grinding wheel which is formed by fitting a cylindrical grindstone chip including abrasive grains to a base metal formed to be of a columnar shape comprises the steps of adhesive agent applying step for applying an adhesive agent, which is used for adhering the base metal and the cylindrical grindstone chip, on at least one of an outer peripheral surface of the base metal and an inner peripheral surface of the cylindrical grindstone chip, a linear guide member arranging step for arranging and attaching a plurality of linear guide members on the one of the outer peripheral surface of the base metal and the inner peripheral surface of the cylindrical grindstone chip, in parallel with a rotation axis of the base metal and with an equal distance separated in a circumferential direction from one another so that the base metal and the cylindrical grindstone chip are suitably fitted to each other and a base metal and grindstone chip fitting step for fitting the base metal and the cylindrical grindstone chip to each other by relatively moving the base metal and the cylindrical grindstone chip, interposing therebetween the plurality of linear guide members arranged and attached with the equal distance separated in the circumferential direction from one another.

According to the above method for manufacturing the grinding wheel, the base metal and the cylindrical grindstone chip are smoothly fitted to each other without generating an inclination between the axial center (the rotation axis) of the base metal and the axial center of the cylindrical grindstone during fitting by interposing the linear guide members arranged and attached between the outer peripheral surface of the base metal and the inner peripheral surface of the cylindrical grindstone chip in a circumferential direction with an equal distance separated from one another. Therefore, a mixing of the air into the inside of the adhesive agent can be prevented by suppressing any elevating or shaving off work for the adhesive agent which has been applied onto the base metal and the cylindrical grindstone chip. Accordingly, an air bubble would not be concealed into the adhesion layer between the outer peripheral surface of the base metal and the inner peripheral surface of the cylindrical grindstone chip, thereby to prevent deterioration of strength of the abrasive grain layer formed on the outer peripheral surface of the base metal. Thus, the extension of life duration of the grinding wheel can be expected. Further, since the plurality of guide members does not occupy so much volume under a state that the plurality of guide member is buried in the adhesion layer, the adhesiveness between the base metal and the cylindrical grindstone chip would not be deteriorated even leaving the guide members between the base metal and the cylindrical grindstone chip after completion of fitting operation therebetween. This can eliminate the removing process of the guide members to thereby improve the efficiency of manufacturing of the grinding wheel.

According to the invention associated with a second aspect, the method for manufacturing the grinding wheel is characterized in that the linear guide member arranging step of the method according to the first aspect is defined for arranging and attaching the plurality of linear guide members with ninety (90) degree equal distance separated in the circumferential direction from one another.

By this arrangement, the plurality of linear guide members can be arranged in two mutually orthogonal directions and accordingly, the deviation of the axial centers of the base metal and the cylindrical grindstone chip can be easily prevented.

According to the invention associated with a third aspect, the method for manufacturing the grinding wheel is characterized in that the plurality of linear guide members used in the method according to the first aspect is made of a synthetic resin.

By this arrangement, the fitting of the base metal and the cylindrical grindstone chip to each other can be smoothly performed due to the smoothness property of the synthetic resin.

According to the invention associated with a fourth aspect, the method for manufacturing the grinding wheel is characterized in that the plurality of linear guide members used in the method according to the first aspect is formed by a string shaped flexible material.

By this arrangement, the string shaped flexible material can follow the shape of the outer peripheral surface of the base metal or the shape of the inner peripheral surface of the cylindrical grindstone chip and can be deformable to align along a direction in which the base metal and the cylindrical grindstone chip are relatively moved. Accordingly, the fitting of the base metal and the cylindrical grindstone chip to each other can be smoothly performed by being guided by the string shaped flexible material.

According to the invention associated with a fifth aspect, the method for manufacturing the grinding wheel is characterized in that the plurality of linear guide members used in the method according to the fourth aspect is formed by a twisted string.

According to this aspect of the invention, the twisted string can be easily deformed by flattening thereof by a predetermined amount, but deformation of the twisted string after exceeding the predetermined value is hard. Therefore, even the size tolerances between the outer diameter of the base metal and the inner diameter of the cylindrical grindstone chip are deviated, such deviation can be absorbed within a range where the deformation of the twisted string can be easily made and the fitting of the base metal and the cylindrical grindstone chip to each other can be surely performed by the guidance of the twist string at the range where the deformation is hard to be made.

BRIEF DESCRIPTION OF THE ATTACHED DRAWINGS

Various aspects of this invention will become apparent to those skilled in the art from the following detailed description of the preferred embodiments, when read in light of the accompanying drawings, in which.

DETAILED DESCRIPTION OF THE PREFERRED EMBODIMENTS OF THE INVENTION

Embodiment of Invention

Figure 1:
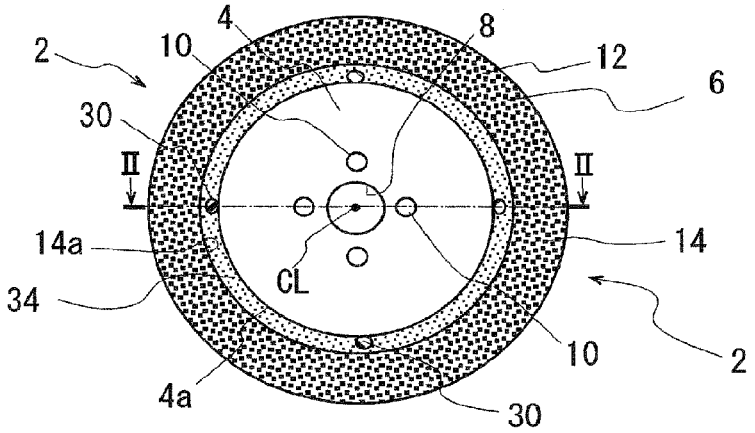
FIG. 1 is a view showing a grinding wheel associated with the present invention.
Figure 2:
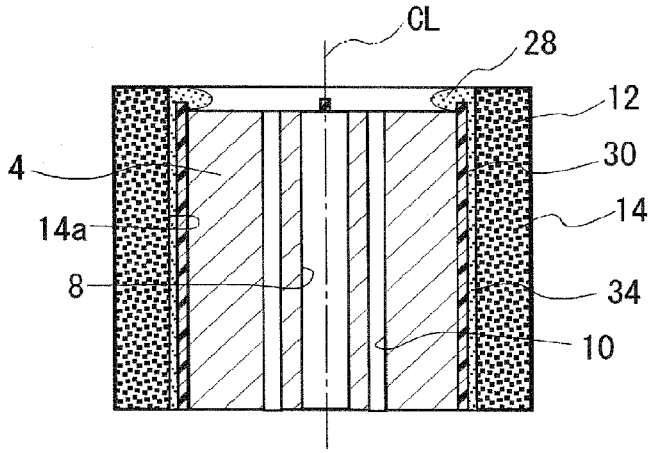
FIG. 2 is a cross sectional view of the grinding wheel taken along the line II-II of FIG. 1.

An embodiment of the invention of method for manufacturing a grinding wheel will be explained with reference to the attached drawings. The grinding wheel 2 to be manufactured according to the invention method is, as shown in FIGS. 1 and 2, formed by a base metal 4 formed to be of columnar shape and a CBN (Cubic Boron Nitride) abrasive grain layer 6 which is formed as an abrasive grain layer on an outer peripheral surface of the base metal 4 with a predetermined width. The base metal 4 is made by a metal, such as for example, iron, titanium alloy or aluminum alloy. A shaft hole 8 is formed on the axis center of the base metal 4, into which a rotation shaft of grinding wheel head (not shown) is fitted. A plurality of attachment holes 10 is provided around the shaft hole 8 in a circumferential direction for assembling the base metal 4 and the rotation shaft of the grinding wheel head by connecting means, such as bolt and nut (not shown). The grinding wheel 2 is rotated about the rotation axis CL.

According to the embodiment, as the super abrasives, CBN abrasive grains 12 with the particle diameter of #30 through #140, for instance, are used for the grinding wheel 2. The CBN abrasive grain layer 6 is formed by connecting the CBN abrasive grains 12 by a vitrified bond. Since the vitrified bond is superior in discharging chips because of the porosity characteristics, the vitrified bond grindstone is superior in the cutting quality to grind a workpiece with a good surface roughness with less amount of wear of the grindstone. However, other binders, such as resin bond or a metal bond may be used instead of the vitrified bond as the binder.

Next, the manufacturing of the cylindrical grindstone chip 14 which forms the CBN abrasive grain layer 6 will be explained hereinafter. First, a grindstone material is obtained by mixing the vitrified bond binder, which is formed by feldspar, clay and fritted glass, the CBN abrasive grains and, depending on necessity, filler.

Figure 3:
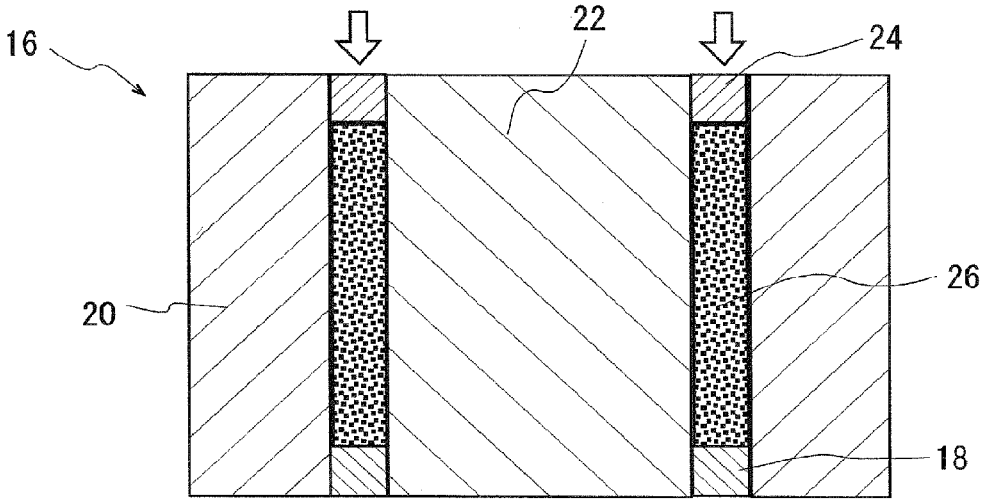
FIG. 3 is a view explaining a press-forming process of the cylindrical grindstone chip.

Then the obtained grindstone material is put into the forming die 16 for forming the grindstone material to be of cylindrical shape. FIG. 3 shows an example of the forming die. The forming die 16 includes an annular lower die 18, an outer die 20 which is fitted to an outer peripheral surface of the lower die 18, a central axis die 22 which is inserted into the inside of the lower die 18 and an upper die 24 which is inserted between the central axis die 22 and the outer die 20.

Figure 4:
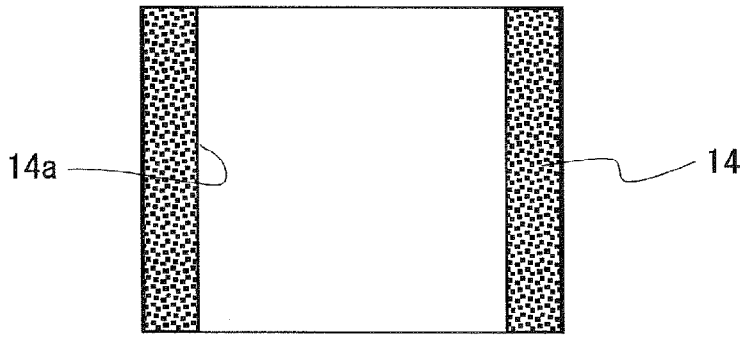
FIG. 4 is a vertical cross sectional view of the cylindrical grindstone chip.

An upper end open space for the forming die is formed by connecting the lower die 18, the outer die 20 and the central axis die 22, respectively with one another. The grindstone material is filled in the obtained upper end open space of the forming die. Then after inserting the upper die 24, the upper die 24 is pressed down from upward by a press machine (not shown) to form a before-burning cylindrical chip 26 and then the cylindrical chip 26 is burned (See FIG. 4).

Figure 5:
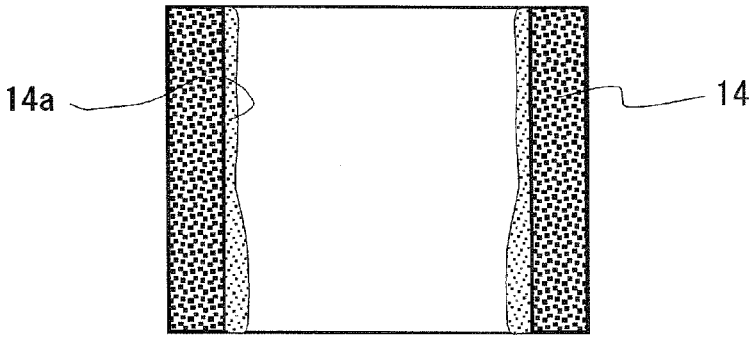
FIG. 5 is a vertical cross sectional view showing a state that an adhesive agent is applied on an inner peripheral surface of the cylindrical grindstone chip.
Figure 6:
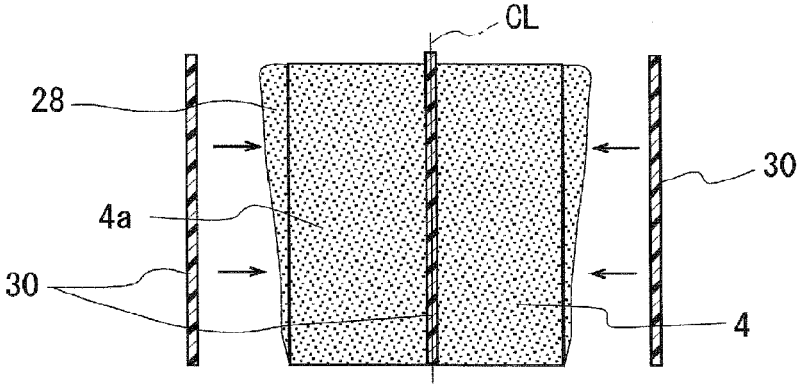
FIG. 6 is a view showing a process of applying the adhesive agent on an outer peripheral surface of the columnar base metal and further attaching the string shaped guide members thereon.

Next, as shown in FIG. 5, the adhesive agent 28 made by a thermosetting resin is applied on the inner peripheral surface 14*a* of the cylindrical grindstone chip 14. Further, as shown in FIG. 6, an adhesive agent 28 made by a thermosetting resin is applied on the outer peripheral surface 4*a* of the base metal 4 of columnar shape which is to be inserted into the cylindrical grindstone chip 14. As an adhesive agent made of a thermosetting resin, for example, an epoxy resin system adhesive agent is used.

Figure 7:
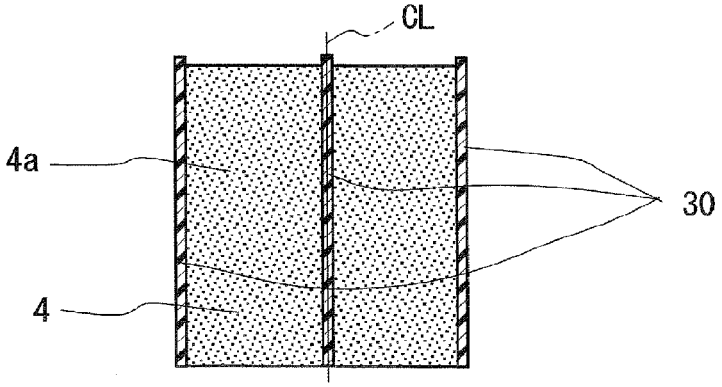
FIG. 7 is a view showing that the guide members are attached on the outer peripheral surface of the columnar base metal in parallel with an axis center and with an equal distance separated from one another in a circumferential direction.

Then, a PE (Polyethylene) line 30 (a twisted string formed by interweaving a plurality of polyethylene fibers) as a string shaped guide member is attached onto the outer peripheral surface 4*a* of the columnar shaped base metal 4 on which the adhesive agent 28 has been applied in parallel with the axial center of the base metal 4 and with a 90 degree equal distance separated from one another in a circumferential direction of the base metal 4. (See FIG. 7).

Figure 8:
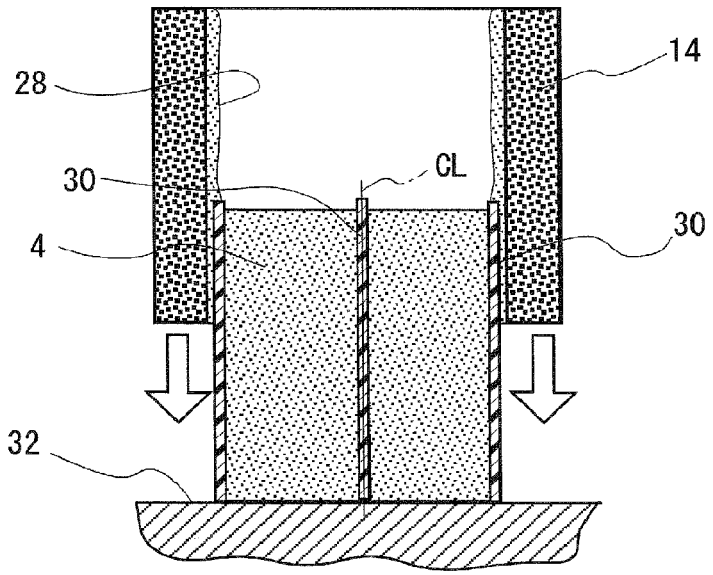
FIG. 8 is a cross sectional view showing a process for fitting the cylindrical grindstone chip to the columnar base metal being guided by the string shaped guide members.

Next, as shown in FIG. 8, the base metal 4 is placed on a base 32 and from the upper side, the cylindrical grindstone chip 14 is fitted to the base metal 4. At this time, for example, a support hole (not shown) which corresponds to the positions of the distributed PE line 30 is provided on the base 32 and then the lower end of the PE line 30 is inserted into the support hole to support the PE line 30. This can prevent the deviation of the PE line 30 from the outer peripheral surface 4*a* of the base metal 4. The cylindrical grindstone chip 14 is guided by the PE line 30 during the fitting operation without inclining with respect to the rotation axis CL, which prevents scooping of the applied adhesive agent 28 that results in elevation or shaving off of the applied adhesive.

Figure 9:
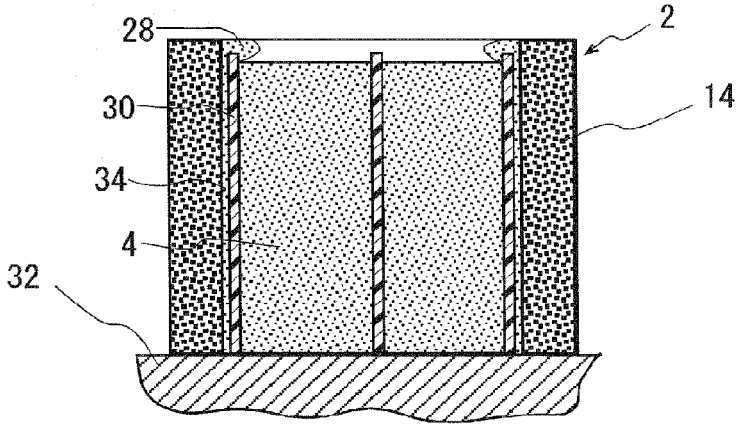
FIG. 9 is a cross sectional view showing a state that the columnar base metal and the cylindrical grindstone chip are fitted to each other.
Figure 10:
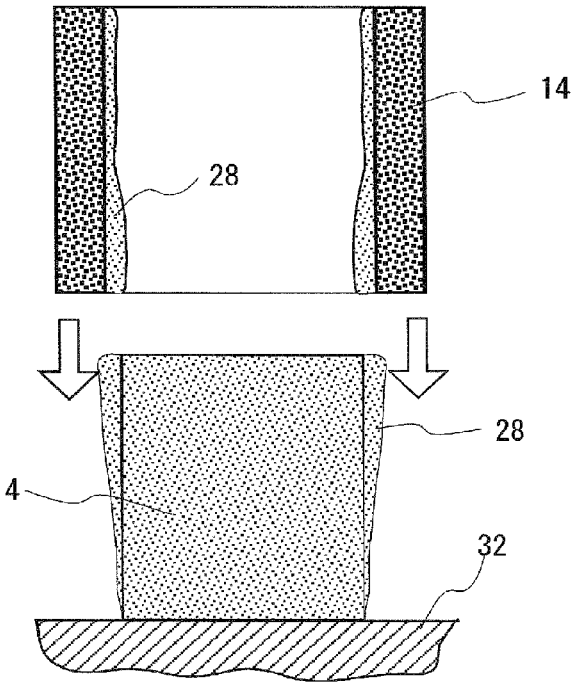
RELATED ART FIG. 10
FIG. 10 is a view showing a fitting process of a conventional technology.
Figure 11:
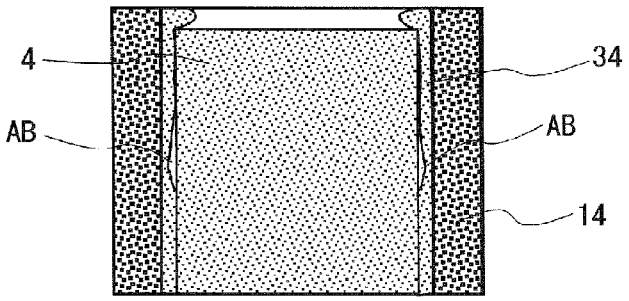
FIG. 11 RELATED ART
FIG. 11 is a view showing a state of grinding wheel which is manufactured according to the conventional method.
Figure 12:
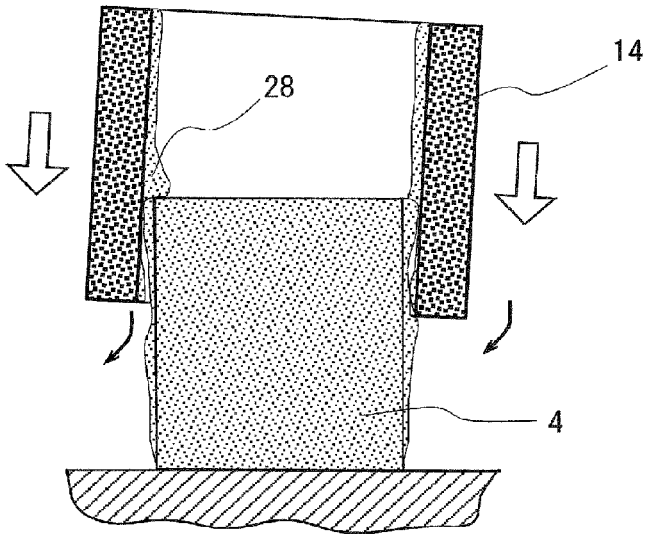
FIG. 12 RELATED ART
FIG. 12 is a view showing a state in a middle stage of fitting process according to the conventional method.
Figure 13:
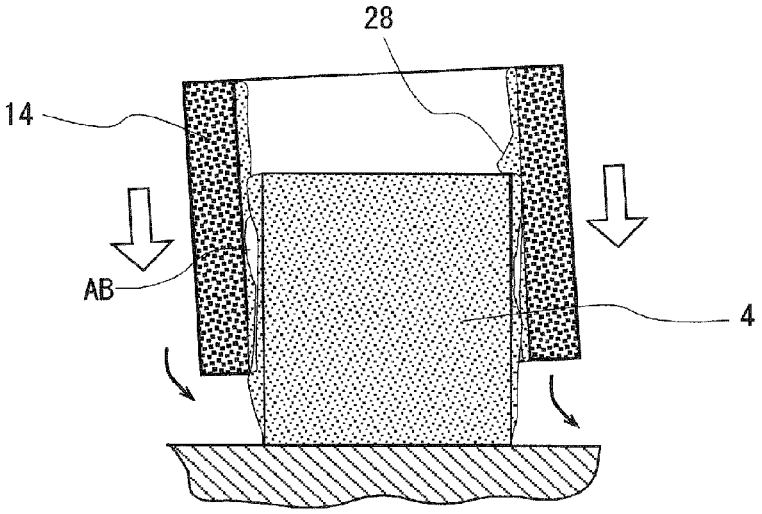
FIG. 13 RELATED ART
FIG. 13 is a view showing a state in another middle stage of fitting process according to the conventional method.

Therefore, as shown in FIG. 9, there is no air bubble AB sealed in the adhesion layer 34 provided between the outer peripheral surface 4*a* of the columnar base metal 4 and the inner peripheral surface 14*a* of the cylindrical grindstone chip 14.

The adhesive agent 28 is hardened by being placed in the drying furnace (not shown) and dried at the temperature of 25 to 150° C. for a predetermined period of time and a grinding wheel 2 with a high binding strength between the base metal 4 and the cylindrical grindstone chip 14 is formed.

Thus manufactured grinding wheel 2 is mounted on the rotation shaft of the grinding wheel head of the grinding machine (not shown) preventing relative rotation therebetween by inserting the rotation shaft into the shaft hole 8 of the base metal 4 of the grinding wheel 2 and inserting bolts through the assembling holes 10 to be screwed to a flange portion of the rotation shaft. According to the embodiment, even when the CBN abrasive grain layer 6 is worn out due to a repetitive use of the grinding wheel 2, no stress concentration is generated at a portion of the adhesion layer 34 because there is no air bubble AB in the adhesion layer 34, so that the grinding wheel 2 can be used over a long time.

According to thus manufactured grinding wheel 2, by providing the plurality of PE lines 30 between the outer peripheral surface 4*a* of the base metal 4 and the inner peripheral surface 14*a* of the cylindrical grindstone chip 14 with an equal distance apart from one another in a circumferential direction, the axis center of the cylindrical grindstone chip 14 would not incline relative to the rotation axis CL of the base metal 4 during the fitting operation and a smooth fitting can be performed between the base metal 4 and the cylindrical grindstone chip 14. Therefore, a mixing of the air into the inside of the adhesive agent can be prevented because it does not happen that the adhesive agent which has been applied onto the base metal is elevated or shaved off by the end brim of the cylindrical grindstone chip 14 during the fitting operation. Accordingly, an air bubble AB would not be concealed into the adhesion layer 34 between the outer peripheral surface 4*a* of the base metal 4 and the inner peripheral surface 14*a* of the cylindrical grindstone chip 14*a*, thereby to eventually prevent deterioration of the strength of the CBN abrasive grain layer 6 formed on the outer peripheral surface of the base metal 4. Accordingly, the durable life of the grinding wheel 2 can be extended. Further, since the PE lines 30 as the plurality of guide members are formed of string shape, the PE lines 30 do not occupy so much volume in the adhesion layer 34 and accordingly, the adhesiveness between the base metal 4 and the cylindrical grindstone chip 14 would not be deteriorated even leaving the PE lines 30 between the base metal 4 and the cylindrical grindstone chip 14 after completion of fitting operation therebetween. This can eliminate the removing process of the guide members to thereby improve the efficiency of manufacturing of the grinding wheel 2.

Further, deviation of the axis centers between the base metal 4 and the cylindrical grindstone chip 14 can be prevented by arranging the plurality of the PE lines 30 with right angles separated from one another in the circumferential direction, i.e., in two directions mutually intersecting at right angle.

Still further, the fitting of the base metal 4 and the cylindrical grindstone chip 14 can be smoothly performed due to the smoothness of the PE lines 30 which is made of a synthetic resin with good smoothness performance characteristics.

Further, since the guide member is formed by a string shaped flexible guide member (PE line 30), the guide member can follow the shape of the outer peripheral surface 4*a* of the base metal 4 or the shape of the inner peripheral surface 14*a* of the cylindrical grindstone chip 14 and can be deformable to align along a direction in which the base metal 4 and the cylindrical grindstone chip 14 are relatively moved. Therefore, the fitting of the base metal 4 and the chip 14 to each other can be extremely smoothly performed by being guided by the string shaped flexible material.

Further, the twisted string can be easily deformable by flattening to a certain degree and can be hardly deformable thereafter. Therefore, even a deviation in dimensional tolerance exists between the outer diameter of the base metal 4 and the inner diameter of the cylindrical grindstone chip 14, such deviation can be absorbed within the easily deformable range of the twisted string and the fitting therebetween can be surely performed thereafter within the hard to be deformable range of the twisted string while being guided by the twisted string.

Although according to the embodiment of the invention explained above, as the plurality of linear guide members, a plurality of string shaped PE lines is used, it is not limited to this shape and any other shapes, such as for example, a rod shaped or a thread shape would be used. Further, according to the embodiment, as the string shaped guide member, a polyethylene made twisted string (PE line) is used. However, it is not limited to the twisted string, but for example, nylon (polyamide system resin) made single line may be used. In case of use of a single line, it is preferable to have the compressive elastic modulus of 3500 to 4500 MPa for such single line. A smooth relative movement between the outer peripheral surface of the base metal and the inner peripheral surface of the cylindrical grindstone chip can be realized by compressively and elastically deforming the string shaped guide member while fitting therebetween.

According to the embodiment, as an adhesive agent 28, an epoxy resin system adhesive agent is used. However, it is not limited to this resin system, but for example, thermosetting resin system adhesive agent, such as a phenol resin system adhesive agent, may be used.

Further, regarding to the cylindrical grindstone chip, the CBN abrasive grain layer 6 is formed by using the vitrified bond as a binder. However, it is not limited to the CBN abrasive grain layer, but a diamond abrasive grain layer may be used which is formed by using a metal bond as the binder, or an aluminum oxide system abrasive grain layer may be used which is formed by binding aluminum oxide system abrasive grains with a resinoid bond as the binder.

Still further, according to the embodiment of the invention, the ratio of length of the cylindrical grind stone chip 14 in an axial direction relative to the diameter of the inner peripheral wall thereof is set to be 1.14. However, the ratio is not limited to this value, but the ratio equal to or more than 0.5 and preferably the ratio of 1.0 or more will be more effective to prevent generation of air bubbles in the adhesion layer.

According to the embodiment, the string shaped guide members are arranged in parallel with the axis center of the base metal and attached with equally right angles separated from one another in the circumferential direction relative to the base metal. However, the arrangement thereof is not limited to this, the string shaped guide members may be arranged with the distance in the circumferential direction with equally 120 degrees or 60 degrees separated from one another.

Obviously, numerous modifications and variations of the present invention are possible in light of the above teachings. It is therefore to be understood that within the scope of the appended claims, the present invention may be practiced otherwise than as specifically described herein.

The invention claimed is:

1. A method for manufacturing a grinding wheel which is formed by fitting a cylindrical grindstone chip including abrasive grains to a base metal formed to be of a columnar shape, the method comprising the steps of:

adhesive agent applying step for applying an adhesive agent, which is used for adhering the base metal and the cylindrical grindstone chip, on at least one of an outer peripheral surface of the base metal and an inner peripheral surface of the cylindrical grindstone chip;

a linear guide member arranging step for arranging and attaching a plurality of linear guide members on the one of the outer peripheral surface of the base metal and the inner peripheral surface of the cylindrical grindstone chip, in parallel with a rotation axis of the base metal and with an equal distance separated in a circumferential direction from one another so that the base metal and the cylindrical grindstone chip are insertable with each other; and a base metal and grindstone chip fitting step for fitting the base metal and the cylindrical grindstone chip to each other by relatively moving the base metal and the cylindrical grindstone chip, interposing therebetween the plurality of linear guide members arranged and attached with the equal distance separated in the circumferential direction from one another.

2. The method for manufacturing the grinding wheel according to claim 1, wherein the linear guide member arranging step is defined for arranging and attaching the plurality of linear guide members with ninety (90) degree equal distance separated in the circumferential direction from one another.

3. The method for manufacturing the grinding wheel according to claim 1, wherein the plurality of linear guide members is made of a synthetic resin.

4. The method for manufacturing the grinding wheel according to claim 1, wherein the plurality of linear guide members is formed by a string shaped flexible material.

5. The method for manufacturing the grinding wheel according to claim 4, wherein the plurality of linear guide members is formed by a twisted string.

6. The method for manufacturing the grinding wheel according to claim 2, wherein the plurality of linear guide members is made of a synthetic resin.

7. The method for manufacturing the grinding wheel according to claim 2, wherein the plurality of linear guide members is formed by a string shaped flexible material.

8. The method for manufacturing the grinding wheel according to claim 3, wherein the plurality of linear guide members is formed by a string shaped flexible material.

* * * * *